US009827797B1

(12) United States Patent
Boland et al.

(10) Patent No.: US 9,827,797 B1
(45) Date of Patent: Nov. 28, 2017

(54) CROSS-FLOW COOLING SYSTEMS FOR CONTINUOUS-FORM PRINT MEDIA

(71) Applicants: Stuart James Boland, Denver, CO (US); Dilan Nirushan Fernando, Thornton, CO (US); Scott Richard Johnson, Erie, CO (US)

(72) Inventors: Stuart James Boland, Denver, CO (US); Dilan Nirushan Fernando, Thornton, CO (US); Scott Richard Johnson, Erie, CO (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/435,822

(22) Filed: Feb. 17, 2017

(51) Int. Cl.
*B41J 29/377* (2006.01)
*B41J 15/04* (2006.01)

(52) U.S. Cl.
CPC ..... *B41J 29/377* (2013.01); *B41J 15/04* (2013.01)

(58) Field of Classification Search
CPC ..... B41J 29/377; B41J 11/002; F26B 13/006; B29C 2035/1616; B29C 35/16; D21F 5/187; G03G 21/206; G03G 2221/1645
See application file for complete search history.

(56) References Cited

U.S. PATENT DOCUMENTS

| | | | | |
|---|---|---|---|---|
| 2,260,364 | A * | 10/1941 | Case | B41F 13/22 101/219 |
| 2,275,588 | A | 3/1942 | Greene | |
| 4,212,113 | A | 7/1980 | Andersson | |
| 4,735,073 | A * | 4/1988 | Schrors | D21G 1/022 100/162 B |
| 4,889,146 | A | 12/1989 | Beal | |
| 4,913,222 | A | 4/1990 | Cowan | |
| 6,586,171 | B1 | 7/2003 | Iwado | |
| 6,888,115 | B2 | 5/2005 | Drozd | |
| 8,197,024 | B2 | 6/2012 | Kovacs et al. | |
| 8,251,505 | B2 | 8/2012 | Hara | |
| 9,457,603 | B2 | 10/2016 | Aerts et al. | |
| 2007/0196152 | A1 | 8/2007 | Shimizu et al. | |

FOREIGN PATENT DOCUMENTS

| | | | |
|---|---|---|---|
| DE | 3312338 | A1 | 11/1983 |
| WO | 2015086289 | A1 | 6/2015 |

* cited by examiner

*Primary Examiner* — Huan Tran
(74) *Attorney, Agent, or Firm* — Duft Bornsen & Fettig LLP

(57) ABSTRACT

Embodiments described herein provide rollers that cool a print medium downstream of a dryer while minimizing the temperature differentials across the print medium. In some embodiments, air is directed through the interiors of different rollers in opposing directions based on a pattern to reduce the temperature differential across a width of the print medium. In other embodiments, a controller alternates a direction of the air through the interior of a roller to reduce the temperature differential across the width of the print medium.

20 Claims, 7 Drawing Sheets

CROSS-FLOW COOLING SYSTEMS FOR CONTINUOUS-FORM PRINT MEDIA

FIELD OF THE INVENTION

The invention relates to the field of printing systems, and in particular, to cooling continuous-form print medium downstream of a dryer of a printing system.

BACKGROUND

Production printing systems for high-volume printing typically utilize a print engine that marks a continuous-form print medium (e.g., paper) with a wet colorant (e.g., an aqueous ink). After marking the print medium, a dryer downstream from the print engine used to dry the colorant applied to the print medium. In some cases, the dryer is integrated within the same assembly as the print engine.

In high-speed production printing systems, it is often desirable to cool the print medium downstream of the dryer to ensure that the print medium does not warp or deform. It is also desirable to cool the print medium downstream of the dryer to ensure that the subsequent print engines used to mark the print medium downstream of the dryer are not impacted by the high temperature of the print medium. Further, it is often desirable to cool the print medium prior to performing post-production processing on the print medium, such as cutting, stapling, folding, etc. Cooling the print medium ensures that the dimensions of the print medium will not change after a post-production activity.

In some cases, cooling rollers are used to cool the print medium by heat transfer. The cooling rollers are disposed downstream of the dryer along a media path of the print medium. However, the cooling rollers may cause temperature differentials across the print medium, which can cause warping of the print medium. The use of fluid-filled (e.g. water) cooling rollers may reduce the temperature differential across print medium, but fluid-filled cooling rollers may be prone to leaking, corrosion, or organic growth. Thus, it would be desirable to ensure that the print medium is adequately cooled while minimizing the temperature differentials across print medium, while mitigating the problems associated with fluid-filed rollers.

SUMMARY

Embodiments described herein utilize hollow rollers that cool a print medium downstream of a dryer while minimizing the temperature differentials across the print medium. In some embodiments, airflows are directed through the interiors of different rollers in opposing directions from each other to reduce the temperature differential across a width of the print medium. In other embodiments, a controller alternates a direction of the airflow through the interior of a roller to reduce the temperature differential across the width of the print medium.

One embodiment comprises a system that cools a continuous-form print medium downstream of a printing system. The system includes a plurality of hollow rollers disposed along a media path of the continuous-form print medium that remove heat from the continuous-form print medium utilizing airflows directed through interiors of the plurality of hollow rollers. The system further includes an air supply that provides the airflows, and ductwork in fluid communication with the air supply that directs the airflows through the interiors of at least two of the plurality of hollow rollers in opposing directions from each other to reduce a temperature differential across a width of the continuous-form print medium.

Another embodiment comprises a system that cools a continuous-form print medium downstream of a printing system. The system includes a plurality of hollow rollers disposed along a media path of the continuous-form print medium that remove heat from the continuous-form print medium utilizing airflows directed through interiors the plurality of hollow rollers. The system further includes an air supply that provides the airflows, and ductwork in fluid communication with the air supply that directs airflow through an interior of at least one of the plurality of hollow rollers in a first direction and an opposing second direction. The system further includes a controller that directs the ductwork to alternate the airflow through the interior of the at least one of the plurality of hollow rollers between the first direction and the opposing second direction to reduce a temperature differential across a width of the continuous-form print medium.

Another embodiment comprises a method of cooling a continuous-form print medium downstream of a printing system. The method comprises receiving the continuous-form print medium at a plurality of hollow rollers disposed along a media path of the continuous-form print medium that remove heat from the continuous-form print medium utilizing airflows directed through interiors the plurality of rollers. The method further comprises alternating a direction of the airflow through an interior of at least one of the plurality of hollow rollers between a first direction and an opposing second direction to reduce a temperature differential across a width of the continuous-form print medium.

Another embodiment comprises a non-transitory computer-readable medium that embodies programmed instructions that direct a processor of a cooling system to cool a continuous-form print medium downstream of a printing system. The programmed instructions direct the cooling system to receive the continuous-form print medium at a plurality of hollow rollers disposed along a media path of the continuous-form print medium that remove heat from the continuous-form print medium utilizing airflows directed through interiors the plurality of hollow rollers. The programmed instructions direct the cooling system to alternate a direction of an airflow through an interior of at least one of the plurality of hollow rollers between a first direction and an opposing second direction to reduce a temperature differential across a width of the continuous-form print medium.

Other exemplary embodiments may be described below.

DESCRIPTION OF THE DRAWINGS

Some embodiments of the present invention are now described, by way of example only, and with reference to the accompanying drawings. The same reference number represents the same element or the same type of element on all drawings.

DESCRIPTION OF THE EMBODIMENTS

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention, and are to be construed as being without limitation to such specifically recited examples and conditions. As a result, the invention is not limited to the specific embodiments or examples described below, but by the claims and their equivalents.

Figure 1:
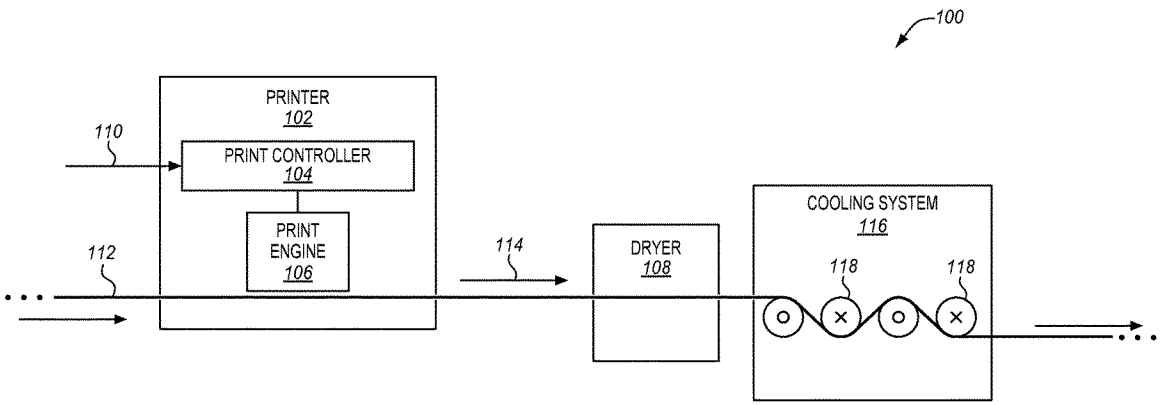
FIG. 1 is a block diagram of a printing system that includes a cooling system in an exemplary embodiment.

FIG. 1 is a block diagram of a printing system 100 in an exemplary embodiment. FIG. 1 also illustrates a print medium 112 (e.g., a continuous-form print medium) that is marked by printing system 100 by a wet or liquid colorant. Some examples of wet or liquid colorants include aqueous inks. Print medium 112 travels along a media path 114 in the direction indicated by the arrow in FIG. 1.

In this embodiment, printing system 100 includes a printer 102. Printer 102 includes a print controller 104 that receives print data 110 for imprinting onto print medium 112, which is rasterized by print controller 104 into bitmap data. The bitmap data is used by a print engine 106 (e.g., a drop-on-demand print engine) of printer 102 to apply wet colorants to print medium 112, which then travels downstream of printer 102 to a dryer 108. Dryer 108 performs a drying process on print medium 112 to dry the wet colorants applied to print medium 112 by printer 102. Dryer 108 may comprise a radiant dryer, a microwave dryer, etc., which heats the wet colorants applied to print medium 112 to evaporate a liquid portion of the wet colorants. This fixes the wet colorants to print medium 112.

In high-speed production printing systems, it is often desirable to cool print medium 112 after print medium 112 exits dryer 108. The cooling of print medium 112 ensures that print medium 112 does not warp or deform downstream of dryer 108. Also, the cooling of print medium 112 may be desirable before print medium 112 is subjected to post-processing activities. In this regard, printing system 100 further includes a cooling system 116, which is located downstream of dryer 108 along media path 114. Cooling system 116 includes a plurality of rollers 118 that are hollow, which are located along media path 114 and are configured to remove heat from print medium 112 utilizing airflows directed through the interiors of rollers 118. Printer 102, dryer 108, and cooling system 116 may be separate device or incorporated with one another in various embodiments.

One problem with the use of cooling rollers in prior printing systems is that sometimes a large temperature differential can exist across the cooling rollers, which can impart a temperature differential across the width of the print media and cause warping or deformation. For example, when air is directed through the interiors of the cooling rollers, one end of the cooling rollers is colder than the other end, since the air picks up heat from the rollers as the air traverses through the roller. If the rollers have air directed through their interiors in the same direction, then the print media may be subjected to a large temperature differential across its width.

In the embodiments described herein, cooling system 116 reduces the temperature differential across a width of print medium 112 by alternating the direction of airflows thorough the interiors of rollers 118, which averages out the temperature differential across the width of print medium 112 during cooling. For example, some of rollers 118 illustrated in FIG. 1 are marked with a "X", which indicates airflows through rollers 118 that are into the page, while other rollers 118 are marked with a "o", which indicates airflows through rollers 118 that are out of the page. Cooling system 116 may alternate a direction of airflows through the interiors of rollers 118 based on a pattern (e.g., every other roller), which averages out the temperature differential across the width of print medium 112 along media path 114. Cooling system 116 may utilize a controller (not shown in FIG. 1), that varies the direction of airflows through the interiors of rollers 118 based on time, based on a measured temperature differential across rollers 118, etc., which averages out the temperature differential across the width of print medium 112. This ensures that print medium 112 can be adequately cooled without warping or deforming. Further, the temperature uniformity across rollers 118 may be improved by managing the thermal conductivity of rollers 118. For example, by selecting specific materials for rollers 118, including internal fins or heat pipes within rollers 118, etc.

Figure 2B:
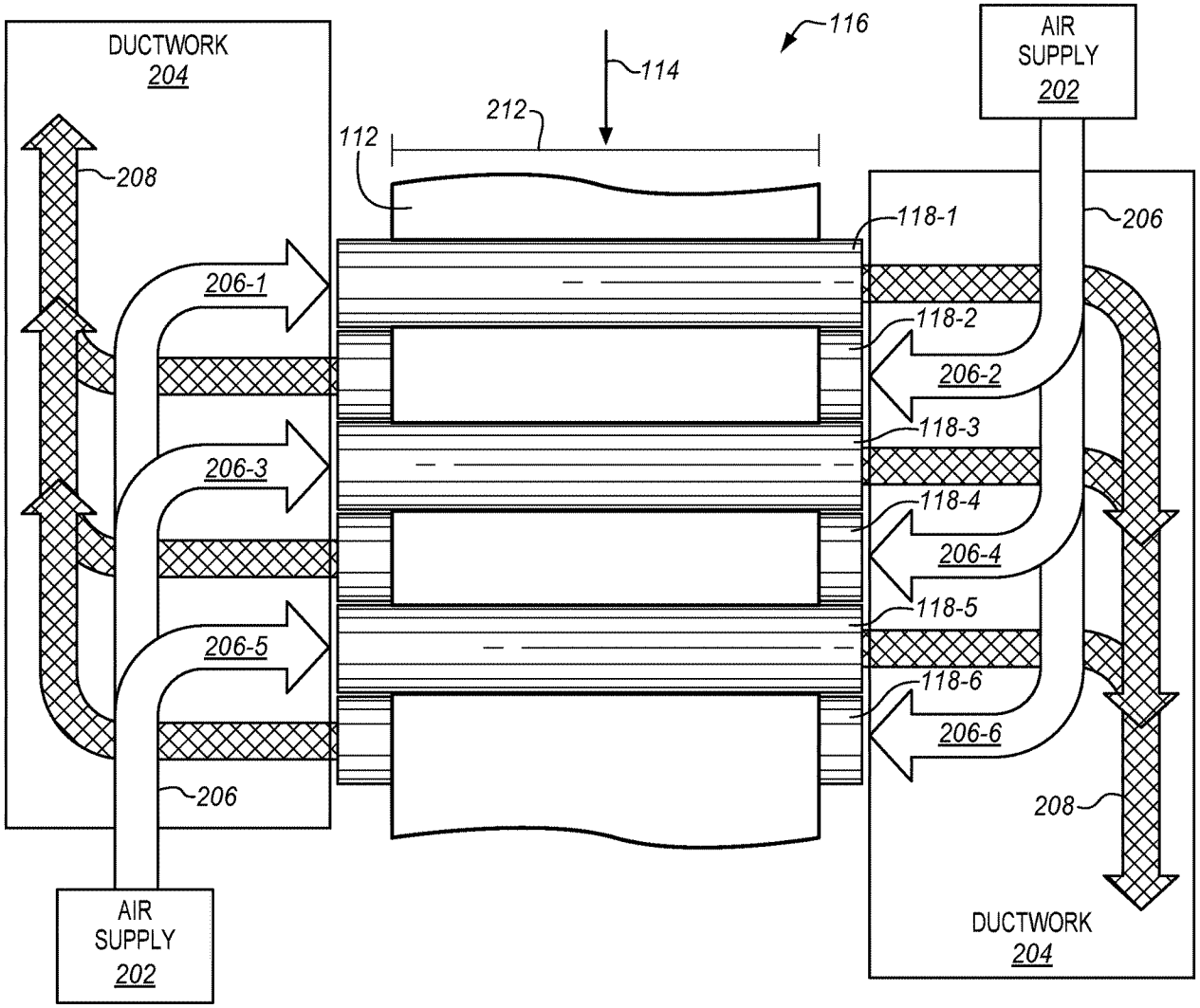
FIGS. 2A and 2B illustrate the cooling system of FIG. 1 in an exemplary embodiment.
Figure 2A:
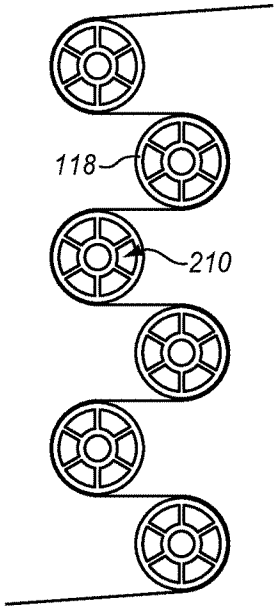

FIGS. 2A & 2B illustrate cooling system 116 of FIG. 1 in an exemplary embodiment. In this embodiment, cooling system 116 includes rollers 118 disposed along media path 114, which are used to cool print medium 112. In FIG. 2A, print medium 112 is applied to rollers 118 from top to bottom in a particular pattern that is illustrated in a side view of rollers 118 illustrated in FIG. 2A. This allows rollers 118 to contact and remove heat from print medium 112. In this embodiment, cooling system 116 includes an air supply 202, which supplies airflows 206 to ductwork 204. Ductwork 204 comprises any system of conduits, dampers, fittings, vents, and manifolds that are capable of delivering and removing air. Ductwork 204 directs airflows 206 to rollers 118 in an alternating pattern along media path 114, which is illustrated as every other roller in FIG. 2B. However, the alternating pattern may be different than every other roller as desired. In FIG. 2B, airflows 206 are directed through interiors 210 of rollers, which are illustrated in the side view of rollers 118. In particular, airflows 206 are directed by ductwork 204 from the left for the first, third, and fifth of rollers 118 (i.e., airflow 206-1 for roller 118-1, airflow 206-3 for roller 118-3, and airflow 206-5 for roller 118-5), which causes the first, third, and fifth of rollers 118 to have an increasing temperature from left to right in FIG. 2. Airflows 206 are directed by ductwork 204 from the right for the second, fourth, and sixth of rollers 118 (i.e., airflow 206-2 for roller 118-2, airflow 206-4 for roller 118-4, and airflow 206-6 for roller 118-6), which causes the second, fourth, and six rollers 118 to have an increasing temperature from right to left in FIG. 2B. Therefore, rollers 118 have opposing temperature differentials along media path 114. This alternating pattern of air flow through interiors 210 of rollers 118 averages out the temperature differential across a width 212 of print medium 112. Averaging out the temperature differential across width 212 of print medium 112 reduces the possibility that print medium 112 will warp or deform during cooling. Warm exhaust air 208 is exhausted from interiors 210 of rollers 118 into ductwork 204, thereby removing heat from rollers 118 and cooling system 116. Preferably, the number of rollers 118 with airflow through interiors 210 in one direction is equal to the number of rollers 118 with airflow through interiors 210 in the opposing direction.

Although a particular alternating pattern of air flow directions are illustrated in FIG. 2B, any alternating pattern of air flow directions through rollers 118 along media path 114 may be implemented as desired. For instance, the air flow through interiors 210 may be reversed for every second roller, every third roller, etc., as desired.

Figure 3B:
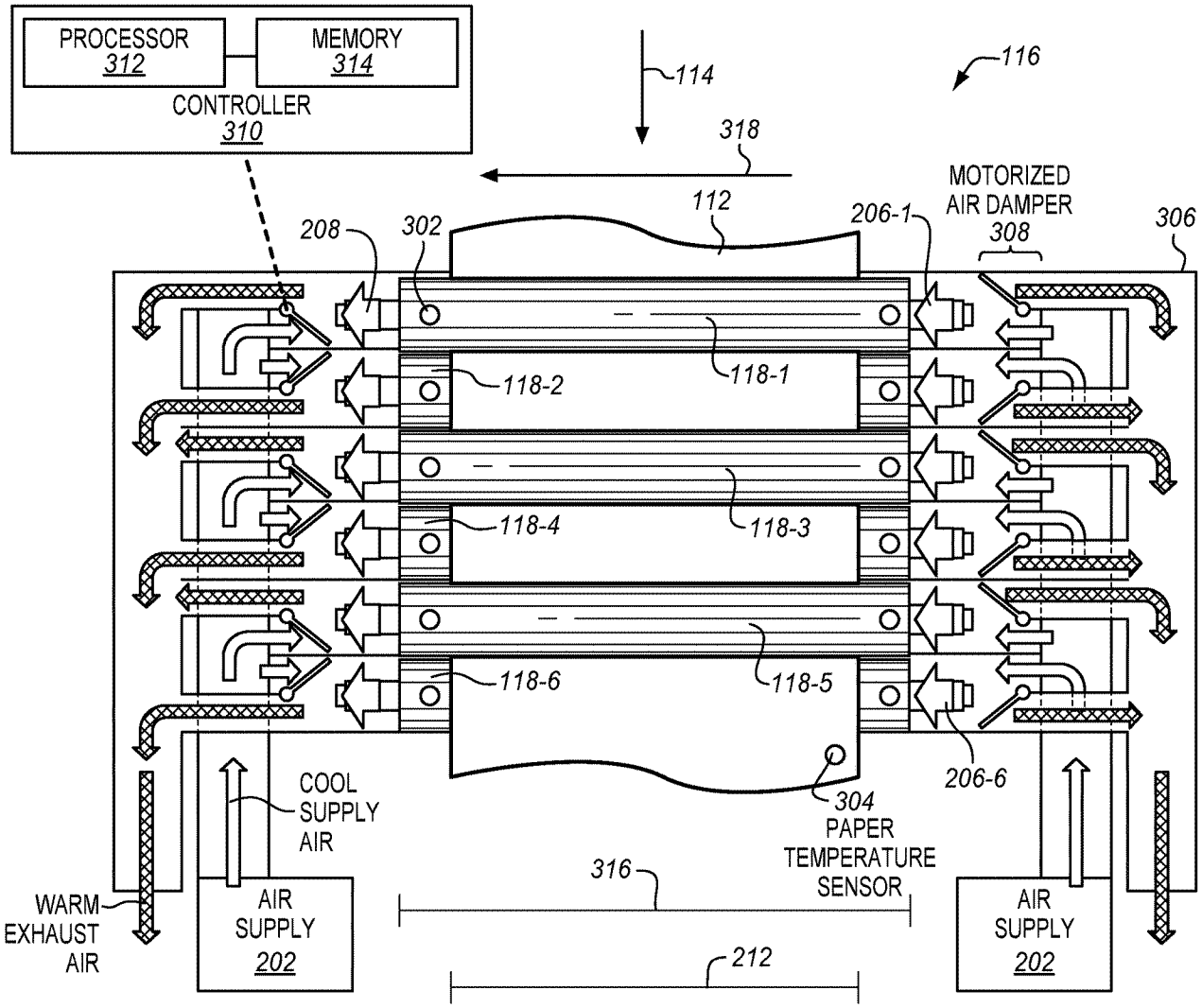
FIGS. 3A, 3B, 4A, and 4B illustrate the cooling system of FIG. 1 in another exemplary embodiment.
Figure 3A:
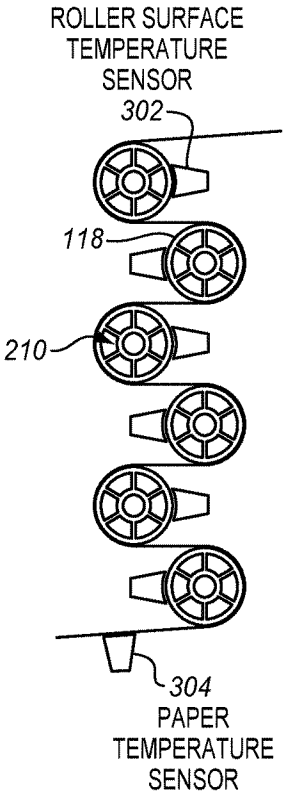
Figure 4B:
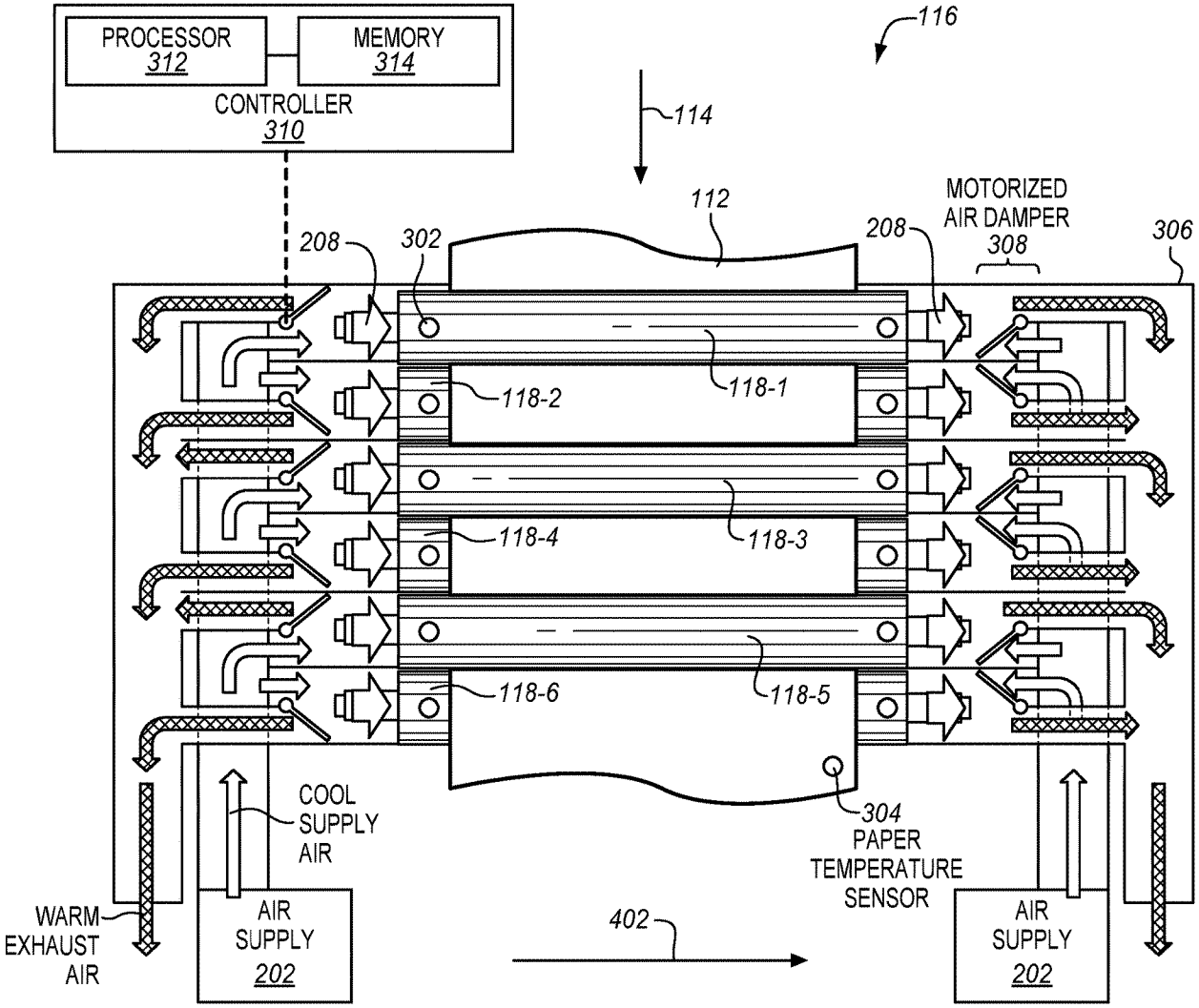
Figure 4A:
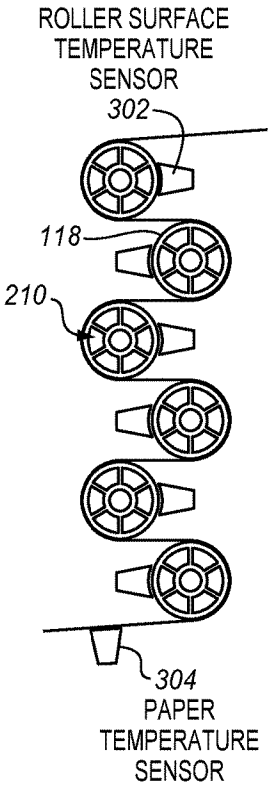

FIGS. 3A, 3B, 4A, and 4B illustrate cooling system 116 of FIG. 1 in another exemplary embodiment. In this embodiment, cooling system 116 includes rollers 118 disposed along media path 114, which are used to cool print medium 112. Print medium 112 is applied to rollers 118 from top to bottom in a particular pattern that is illustrated in a side view of rollers 118 in FIGS. 3A and 4A. This allows rollers 118 to contact and remove heat from print medium 112. In this embodiment, cooling system 116 includes air supply 202, which supplies airflows 206 to ductwork 306. Ductwork 306 comprises any system of conduits, dampers, fittings, vents, and manifolds that is capable of delivering and removing air. Ductwork 306 includes dampers 308 that are able to move to control the direction of airflows 206 through interiors 210 of rollers 118, which are controlled by a controller 310. For instance, controller 310 may configure dampers 308 to supply airflows 206 from right to left through rollers 118 (e.g., a first direction 318), as illustrated in FIG. 3B. Or, controller 310 may configure dampers 308 to supply airflows 206 from left to right through interiors 210 of rollers 118 (e.g., an opposing second direction 402), as illustrated in FIG. 4B. Alternating the directions of airflows 206 through interiors 210 of at least one of rollers 118 by controller 310 reduces the temperature differential across width 212 of print medium 112 as print medium 112 travels along media path 114 through cooling system 116. Warm exhaust air 208 is exhausted from interiors 210 of rollers 118 into ductwork 306, thereby removing heat from rollers 118 and cooling system 116.

In some embodiments, controller 310 may vary the direction through interiors 210 of rollers 118 based on time (i.e., at a pre-determined rate). For instance, controller 310 may vary the direction once per minute, once per several minutes, etc. Although FIGS. 3B and 4B illustrate that the directions of airflows 206 through interiors 210 of rollers 118 are the same for each of rollers 118, the direction through interiors 210 of rollers 118 are individually configurable. For example, airflows 206 may flow in a left to right direction through interior 210 of roller 118-1 (e.g., opposing second direction 402), in contrast to the right to left direction illustrated for rollers 118-2 to 118-6 illustrated in FIG. 3B (e.g., first direction 318). Therefore, controller 310 may vary the pattern of air flow through interiors 210 of rollers 118 along media path 114 based on any particular trigger as desired. For instance, in some embodiments, paper temperature sensors 304 may be utilized by cooling system 116 to measure a temperature of print medium proximate to the edges of print medium 112 across width 212. Controller 310 may monitor the differential temperature across width 212 of print medium 112 utilizing paper temperature sensors 304, and vary the direction of air flow through interiors 210 of rollers 118 and/or the pattern of air flow through rollers 118 along media path 114 as desired to reduce the temperature differential across width 212 print medium 112. For instance, controller 310 may alternate the direction of air through interiors 210 of rollers 118 if the temperature differential across rollers 118 is greater than a threshold temperature. One example of a threshold temperature is 10 degrees Celsius.

In some embodiments, roller temperature sensors 302 may be utilized by cooling system 116, which measures temperatures of one or more rollers 118 near outside edges of rollers 118. Controller 310 may monitor a differential temperature across the one or more rollers 118, and vary the direction of airflows 206 through interiors 210 of rollers 118 as desired to reduce the temperature differential across width 212 of print medium 112. For instance, if controller 310 may monitor the temperature differential across one or more rollers 118, and utilize dampers 308 to reverse, switch, or select an opposing direction for the airflows 206 through one or more rollers 118 to average out the temperature differential across width 212 of print medium 112.

In some embodiments, controller 310 may alternate between first direction 318 and opposing second direction 402 illustrated in FIGS. 3B and 4B based on width 212 of print medium 112. This may be beneficial when print medium 112 is narrow (e.g., width 212 of print medium 112 is half of a length 316 of rollers 118), and print medium 112 is right or left justified at rollers 118. Controller 310 may vary the pre-defined rate of alternating the direction of airflows 206 through interiors 210 of rollers 118 based on a width of print medium 112.

In some embodiments, controller 310 may vary the pre-defined rate of alternating the direction of airflows 206 through interiors 210 of rollers 118 based on a thickness of print medium 112, since a thickness of print medium 112 may affect the thermal characteristics of print medium 112.

In this embodiment, controller 310 includes a processor 312 and a memory 314. While the specific hardware implementation of controller 310 is subject to design choices, one particular embodiment may include one or more processors 312 communicatively coupled with memory 314. Processor 312 includes any electronic circuits and/or optical circuits that are able to perform functions. For example, processor 312 may perform any functionality described herein for controller 310. Processor 312 may include one or more Central Processing Units (CPU), microprocessors, Digital Signal Processors (DSPs), Application-specific Integrated Circuits (ASICs), Programmable Logic Devices (PLDs), control circuitry, etc. Some examples of processors include INTEL® CORE™ processors, Advanced Reduced Instruction Set Computing (RISC) Machines (ARM®) processors, etc.

Memory 314 includes any electronic circuits, and/or optical circuits, and/or magnetic circuits that are able to store data. For instance, memory 314 may store programmed instructions for processor 312 to implement the functionality described herein for controller 310, etc. Memory 314 may include one or more volatile or non-volatile Dynamic Random Access Memory (DRAM) devices, FLASH devices, volatile or non-volatile Static RAM devices, magnetic disk drives, Solid State Disks (SSDs), etc. Some examples of non-volatile DRAM and SRAM include battery-backed DRAM and battery-backed SRAM.

Figure 5:
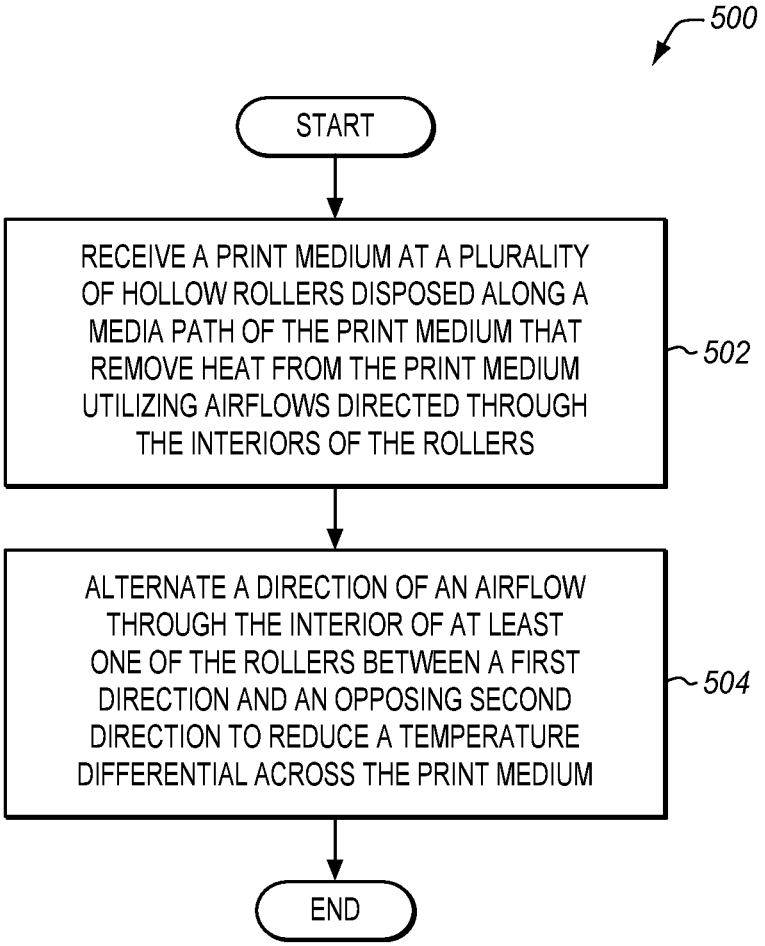
FIG. 5 is a flow chart of a method of cooling a continuous-form print medium downstream of the printing system in an exemplary embodiment.

FIG. 5 is a flow chart of a method 500 of cooling a continuous-form print medium downstream of a printing system in an exemplary embodiment. The steps of method 500 will be described with respect to cooling system 116, although method 500 may be performed by other systems, not shown. The methods described herein may include other steps, not shown. Also, the steps described herein may be performed in an alternate order.

Cooling system 116 receives print medium 112 at rollers 118, and ductwork 306 provides airflows 206 to interiors 210 of rollers 118 (see step 502). Rollers 118 remove heat from print medium 112, which is exhausted from rollers 118 as warm exhaust air 208. Processor 312 is able to control dampers 308 to vary the direction of air through interiors 210 of rollers 118 (see step 504). For example, processor 312 may direct airflow 206-1 in first direction 318 through roller 118-1 as illustrated in FIG. 3B, and then switch or reverse the direction of airflow 206-1 through interior 210 of roller 118-1 to opposing second direction 402 as illustrated in FIG. 4B. Processor 312 may therefore alternate the direction of airflows 206 through one or more rollers (e.g., roller 118-1) between first direction 318 and opposing second direction 402 to reduce a temperature differential across width 212 of print medium 112.

Figure 6:
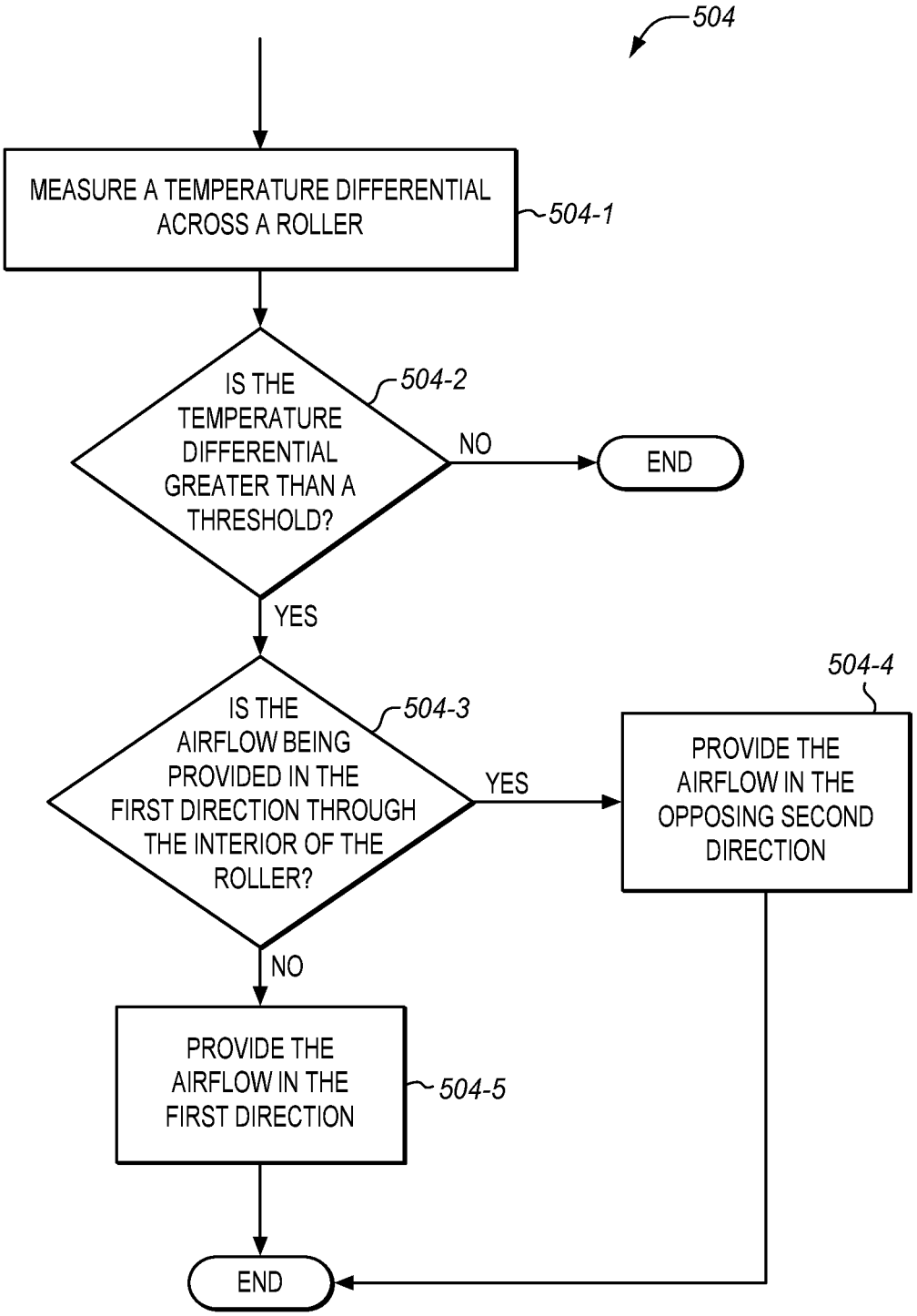
FIG. 6 is a flow chart of additional details of a step of the method of FIG. 5 in an exemplary embodiment.

FIG. 6 is a flow chart of additional details of step 504 of method 500 in an exemplary embodiment. When roller temperature sensors 302 are present in cooling system 116, processor 312 may measure a temperature differential across a roller (e.g., roller 118-1, see step 504-1), and determine if the temperature differential is greater than a threshold (see step 504-2). If the temperature differential is not greater than the threshold, then method 500 ends. However, if the temperature differential is greater than the threshold, then processor 312 determines which direction that airflow 206-1 is being directed through interior 210 of roller 118-1 (e.g., first direction 318 or opposing second direction 402, see step 504-3). If airflow 206-1 is being provided through interior 210 of roller 118-1 in first direction 318, then processor 312 directs dampers 308 to reverse or switch the direction of airflow 206-1 to opposing second direction 402 for roller 118-1 (see step 504-4). If airflow 206-1 is being provide to roller 118-1 in opposing second direction 402, then processor 312 directs dampers 308 to reverse or switch the direction of airflow 206-1 to first direction 318 (see step 504-5). Upon reversing or switching the direction, the temperature differential across the roller begins to reverse, since a hot end of roller 118-1 is now being provided with airflow 206-1.

Figure 7:
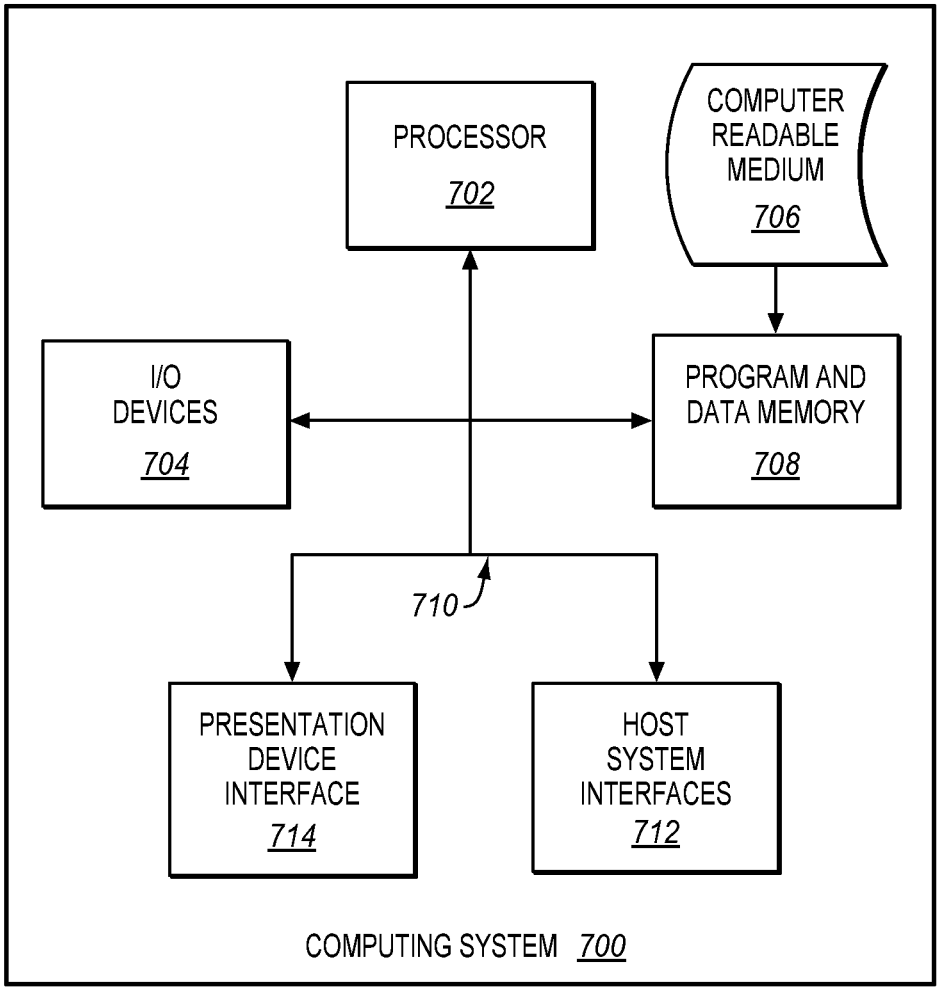
FIG. 7 illustrates a computing system in which a computer-readable medium may provide instructions for performing the functions described herein in an exemplary embodiment.

The invention can take the form of an entirely hardware embodiment, an entirely software embodiment or an embodiment containing both hardware and software elements. In one embodiment, the invention is implemented in software, which includes but is not limited to firmware, resident software, microcode, etc. FIG. 7 illustrates a computing system 700 in which a computer-readable medium 706 may provide instructions for performing the functions described herein in an exemplary embodiment.

Furthermore, the invention can take the form of a computer program product accessible from a computer-usable or computer-readable medium 706 providing program code for use by or in connection with a computer or any instruction execution system. For the purposes of this description, a computer-usable or computer-readable medium 706 can be any apparatus that can contain, store, communicate, or transport the program for use by or in connection with the instruction execution system, apparatus, or device.

Computer-readable medium 706 can be an electronic, magnetic, optical, electromagnetic, infrared, or semiconductor system (or apparatus or device) or a propagation medium. Examples of a computer-readable medium 706 include a semiconductor or solid state memory, magnetic tape, a removable computer diskette, a random-access memory (RAM), a read-only memory (ROM), a rigid magnetic disk and an optical disk. Current examples of optical disks include compact disk-read only memory (CD-ROM), compact disk-read/write (CD-R/W) and DVD.

A data processing system suitable for storing and/or executing program code will include one or more processors 702 coupled directly or indirectly to memory 708 through a system bus 710. The memory 708 can include local memory employed during actual execution of the program code, bulk storage, and cache memories which provide temporary storage of at least some program code in order to reduce the number of times code is retrieved from bulk storage during execution.

Input/output or I/O devices 704 (including but not limited to keyboards, displays, pointing devices, sensors, motor drivers, etc.) can be coupled to the system either directly or through intervening I/O controllers.

Network adapters may also be coupled to the system to enable the data processing system to become coupled to other data processing systems, such a through host systems interfaces 712, or remote printers or storage devices through intervening private or public networks. Modems, cable modem and Ethernet cards are just a few of the currently available types of network adapters. A presentation device interface (I/F) 714 may be used to present information to a user.

Although specific embodiments were described herein, the scope of the invention is not limited to those specific embodiments. The scope of the invention is defined by the following claims and any equivalents thereof.

What is claimed is:

1. A system configured to cool a continuous-form print medium downstream of a printing system, the system comprising:

a plurality of hollow rollers disposed along a media path of the continuous-form print medium that remove heat from the continuous-form print medium utilizing airflows directed through interiors of the plurality of hollow rollers;

an air supply configured to provide the airflows; and ductwork in fluid communication with the air supply that is configured to direct the airflows through the interiors of at least two of the plurality of hollow rollers in opposing directions from each other to reduce a temperature differential across a width of the continuous-form print medium.

2. The system of claim 1, wherein:

the ductwork is configured to direct the airflows in alternating directions for every other hollow roller of the plurality of hollow rollers.

3. A system configured to cool a continuous-form print medium downstream of a printing system, the system comprising:

a plurality of hollow rollers disposed along a media path of the continuous-form print medium that remove heat from the continuous-form print medium utilizing airflows directed through interiors the plurality of hollow rollers;

an air supply configured to provide the airflows;

ductwork in fluid communication with the air supply that is configured to direct an airflow through an interior of at least one of the plurality of hollow rollers in a first direction and an opposing second direction; and a controller configured to direct the ductwork to alternate the airflow through the interior of the at least one of the plurality of hollow rollers between the first direction and the opposing second direction to reduce a temperature differential across a width of the continuous-form print medium.

4. The system of claim 3, wherein:

the controller is configured to direct the ductwork to alternate the airflow through the interior of the at least one of the plurality of hollow rollers between the first direction and the opposing second direction at a pre-defined rate.

5. The system of claim 4, wherein:

the controller is configured to vary the pre-defined rate based on the width of the continuous-form print medium.

6. The system of claim 4, wherein:

the controller is configured to vary the pre-defined rate based on a thickness of the continuous-form print medium.

7. The system of claim 4, further comprising:

at least one sensor configured to measure a temperature differential across the at least one of the plurality of hollow rollers, wherein the controller is configured to make a determination that the temperature differential is greater than a threshold, and to direct the ductwork to:

direct the airflow through the interior of the at least one of the plurality of hollow rollers in the first direction in response to the airflow being currently in the opposing second direction; and directing the airflow through the interior of the at least one of the plurality of hollow rollers in the opposing second direction in response to the airflow being currently in the first direction.

8. The system of claim 7, wherein:

the threshold is less than ten degrees Celsius.

9. A method of cooling a continuous-form print medium downstream of a printing system, the method comprising:

receiving the continuous-form print medium at a plurality of hollow rollers disposed along a media path of the continuous-form print medium that remove heat from the continuous-form print medium utilizing airflows directed through interiors the plurality of hollow rollers; and alternating a direction of an airflow through an interior of at least one of the plurality of hollow rollers between a first direction and an opposing second direction to reduce a temperature differential across a width of the continuous-form print medium.

10. The method of claim 9, wherein alternating the direction further comprises:

alternating the direction of the airflow through the interior of the at least one of the plurality of hollow rollers between the first direction and the opposing second direction at a pre-defined rate.

11. The method of claim 10, wherein alternating the direction further comprises:

varying the pre-defined rate based on the width of the continuous-form print medium.

12. The method of claim 10, wherein alternating the direction further comprises:

varying the pre-defined rate based on a thickness of the continuous-form print medium.

13. The method of claim 9, further comprising:

measuring a temperature differential across the at least one of the plurality of hollow rollers;

making a determination that the temperature differential is greater than a threshold;

directing the airflow through the interior of the at least one of the plurality of hollow rollers in the first direction in response to the airflow being currently in the opposing second direction; and direct the airflow through the interior of the at least of the plurality of hollow rollers in the opposing second direction in response to the airflow being currently in the first direction.

14. The method of claim 13, wherein:

the threshold is less than ten degrees Celsius.

15. A non-transitory computer-readable medium embodying programmed instructions that direct a processor of a cooling system to cool a continuous-form print medium downstream of a printing system, the programmed instructions directing the cooling system to:

receive the continuous-form print medium at a plurality of hollow rollers disposed along a media path of the continuous-form print medium that remove heat from the continuous-form print medium utilizing airflows directed through interiors the plurality of hollow rollers; and alternate a direction of an airflow through an interior of at least one of the plurality of hollow rollers between a first direction and an opposing second direction to reduce a temperature differential across a width of the continuous-form print medium.

16. The non-transitory computer-readable medium of claim 15, wherein the programmed instructions to alternate the direction further direct the cooling system to:

alternate the direction of the airflow through the interior of the at least one of the plurality of hollow rollers between the first direction and the opposing second direction at a pre-defined rate.

17. The non-transitory computer-readable medium of claim 16, wherein the programmed instructions to alternate the direction further direct the cooling system to:

vary the pre-defined rate based on the width of the continuous-form print medium.

18. The non-transitory computer-readable medium of claim 16, wherein the programmed instructions to alternate the direction further direct the cooling system to:

vary the pre-defined rate based on a thickness of the continuous-form print medium.

19. The non-transitory computer-readable medium of claim 16, wherein the programmed instructions further direct the cooling system to:

measure a temperature differential across the at least one of the plurality of hollow rollers;

make a determination that the temperature differential is greater than a threshold;

direct the airflow through the interior of the at least one of the plurality of hollow rollers in the first direction in response to the airflow being currently in the opposing second direction; and direct the airflow through the interior of the at least one of the plurality of hollow rollers in the opposing second direction in response to the airflow being currently in the first direction.

20. The non-transitory computer-readable medium of claim 19, wherein the threshold is less than ten degrees Celsius.

* * * * *